US009819099B2

(12) United States Patent
Finona

(10) Patent No.: US 9,819,099 B2
(45) Date of Patent: Nov. 14, 2017

(54) MULTI-PART CONTACT HAVING A FRONT CONTACT PORTION AND A REAR CRIMP CONTACT PORTION JOINED TOGETHER AT AN ANGLE BY A THREADED CONNECTOR

(71) Applicant: ITT Manufacturing Enterprises LLC, Wilmington, DE (US)

(72) Inventor: Michael Santos Finona, Fountain Valley, CA (US)

(73) Assignee: ITT MANUFACTURING ENTERPRISES LLC, Wilmington, DE (US)

( * ) Notice: Subject to any disclaimer, the term of this patent is extended or adjusted under 35 U.S.C. 154(b) by 0 days.

(21) Appl. No.: 15/222,722

(22) Filed: Jul. 28, 2016

(65) Prior Publication Data

US 2017/0047669 A1 Feb. 16, 2017

Related U.S. Application Data

(60) Provisional application No. 62/204,851, filed on Aug. 13, 2015.

(51) Int. Cl.

| | |
|---|---|
| ***H01R 4/10*** | (2006.01) |
| ***H01R 4/56*** | (2006.01) |
| ***H01R 43/048*** | (2006.01) |
| ***H01R 4/20*** | (2006.01) |
| ***H01R 13/11*** | (2006.01) |
| ***H01R 4/62*** | (2006.01) |
| ***H01R 13/62*** | (2006.01) |

(Continued)

(52) U.S. Cl.

CPC ..... *H01R 4/56* (2013.01); *H01R 4/20* (2013.01); *H01R 4/625* (2013.01); *H01R 13/111* (2013.01); *H01R 13/62* (2013.01); *H01R 43/048* (2013.01); *H01R 4/183* (2013.01); *H01R 13/187* (2013.01)

(58) Field of Classification Search

CPC . H01R 4/20; H01R 4/56; H01R 4/185; H01R 4/188; H01R 4/625; H01R 13/62; H01R 13/111; H01R 13/567; H01R 13/5841; H01R 43/048

USPC ..... 439/877–881

See application file for complete search history.

(56) References Cited

U.S. PATENT DOCUMENTS

| | | | |
|---|---|---|---|
| 1,583,087 | A | 5/1926 | Morse |
| 2,000,318 | A | 5/1935 | Cannon |

(Continued)

FOREIGN PATENT DOCUMENTS

| | | |
|---|---|---|
| DE | 3709942 | 10/1988 |
| DE | 42 10 491 | 10/1993 |

(Continued)

OTHER PUBLICATIONS

Extended European Search Report for Application No. 16183368.6, dated Dec. 14, 2016.

*Primary Examiner* — Chandrika Prasad

(74) *Attorney, Agent, or Firm* — Knobbe, Martens, Olson & Bear LLP

(57) ABSTRACT

A crimp contact is provided where the axes of the contact form a non-linear angle, such as a 90° angle. The crimp contact can be a multi-part contact with a front contact portion that is attached in a removable or fixed manner to the rear crimp contact portion. The front contact portion can be attached to the rear crimp contact portion using a threaded connector to form a threaded attachment.

19 Claims, 3 Drawing Sheets

(51) Int. Cl.
*H01R 4/18* (2006.01)
*H01R 13/187* (2006.01)

(56) References Cited

U.S. PATENT DOCUMENTS

| | | | | |
|---|---|---|---|---|
| 2,374,971 | A | 5/1945 | Benander | |
| 2,677,811 | A | 5/1954 | Anderson et al. | |
| 2,761,111 | A | 8/1956 | Klostermann | |
| 2,916,720 | A | 12/1959 | Steans | |
| 2,933,711 | A | 4/1960 | Eaton | |
| 3,237,147 | A | 2/1966 | Elliott et al. | |
| 3,352,576 | A | 11/1967 | Thorne-Thomson | |
| 3,747,048 | A | 7/1973 | Johnson et al. | |
| 3,768,065 | A | 10/1973 | Zemels | |
| 3,848,949 | A | 11/1974 | Falkner | |
| 3,962,692 | A | 6/1976 | Murphy et al. | |
| 3,995,930 | A | 12/1976 | Hermann, Jr. | |
| 4,186,983 | A | 2/1980 | Kaye | |
| 4,202,591 | A | 5/1980 | Borgstrom | |
| 4,364,624 | A | 12/1982 | Williams | |
| 4,708,663 | A | 11/1987 | Eckart | |
| 4,711,510 | A | 12/1987 | Orlando, Jr. | |
| 4,758,171 | A | 7/1988 | Hey | |
| 4,929,188 | A | 5/1990 | Lionetto et al. | |
| 5,195,904 | A | 3/1993 | Cyvoct | |
| 5,263,877 | A * | 11/1993 | Mitani | H01R 9/0518 439/582 |
| 5,275,575 | A | 1/1994 | Cahaly et al. | |
| 5,288,242 | A | 2/1994 | Muzslay | |
| 5,314,345 | A | 5/1994 | Cahaly et al. | |
| 5,743,754 | A | 4/1998 | Cristich | |
| 5,911,595 | A | 6/1999 | Orr et al. | |
| 5,938,465 | A | 8/1999 | Fox, Sr. | |
| D420,328 | S | 2/2000 | Burwell et al. | |
| 6,224,421 | B1 | 5/2001 | Maturo, Jr. | |
| 6,264,474 | B1 | 7/2001 | Weller et al. | |
| 6,332,815 | B1 | 12/2001 | Bruce | |
| D478,318 | S | 8/2003 | Burwell et al. | |
| 6,709,289 | B2 | 3/2004 | Huber et al. | |
| 6,799,984 | B2 | 10/2004 | Starta et al. | |
| 6,966,781 | B1 | 11/2005 | Bullinger et al. | |
| 7,274,964 | B2 | 9/2007 | Balsells | |
| 7,481,673 | B1 | 1/2009 | Qu et al. | |
| 7,597,588 | B1 | 10/2009 | Hyzin et al. | |
| 7,632,121 | B2 | 12/2009 | Gonzales et al. | |
| 8,100,707 | B2 | 1/2012 | Kussel et al. | |
| 8,375,543 | B1 | 2/2013 | Balsells | |
| 8,491,345 | B2 | 7/2013 | Leon et al. | |
| 8,496,494 | B2 | 7/2013 | Jordan | |
| 9,048,551 | B2 * | 6/2015 | Picaud | H01R 4/34 |
| D734,264 | S | 7/2015 | Jordan | |
| 9,407,029 | B2 | 8/2016 | Jordan | |
| 2002/0160645 | A1 | 10/2002 | Nagamine et al. | |
| 2005/0026498 | A1 | 2/2005 | Ikeda et al. | |
| 2006/0046578 | A1 | 3/2006 | Karadimas et al. | |
| 2006/0154510 | A1 | 7/2006 | Annecke | |
| 2006/0252296 | A1 | 11/2006 | Wu | |
| 2007/0026695 | A1 | 2/2007 | Lee et al. | |
| 2007/0093120 | A1 * | 4/2007 | Hardy | H01R 13/506 439/468 |
| 2007/0190868 | A1 | 8/2007 | Cloet et al. | |
| 2008/0166912 | A1 | 7/2008 | Siebens et al. | |
| 2010/0075545 | A1 * | 3/2010 | De Blieck | H01R 43/16 439/741 |
| 2010/0100997 | A1 | 4/2010 | Lee et al. | |
| 2012/0021645 | A1 * | 1/2012 | Marsh | H01R 11/12 439/578 |
| 2015/0079825 | A1 * | 3/2015 | Miyamoto | H01R 4/206 439/152 |
| 2016/0099518 | A1 | 4/2016 | Jordan | |

FOREIGN PATENT DOCUMENTS

| | | |
|---|---|---|
| DE | 10 2006 006 845 | 7/2007 |
| EP | 0 050 575 | 4/1982 |
| EP | 0 579 551 | 1/1994 |
| EP | 0 579 884 | 1/1994 |
| EP | 1 819 019 | 8/2007 |
| EP | 2 362 492 | 8/2011 |
| EP | 2 757 639 | 7/2014 |
| GB | 2 083 296 | 3/1982 |
| GB | 2469023 | 10/2010 |
| GB | 2 477 987 | 8/2011 |
| GB | 2 509 924 | 7/2014 |
| NL | 8802529 | 5/1990 |
| WO | WO 01/015286 | 3/2001 |
| WO | WO 2011/061074 | 5/2011 |
| WO | WO 2014/114323 | 7/2014 |

* cited by examiner

MULTI-PART CONTACT HAVING A FRONT CONTACT PORTION AND A REAR CRIMP CONTACT PORTION JOINED TOGETHER AT AN ANGLE BY A THREADED CONNECTOR

RELATED APPLICATIONS

Any applications for which a foreign or domestic priority claim is identified in the Application Data Sheet of the present application are hereby incorporated by reference under 37 CFR 1.57.

FIELD

Aspects described herein relate to a crimp power contact where the wire and contact front end can be aligned along different axes.

BACKGROUND

Crimp contacts are one option for providing a contact within a connector, such as a connector for high power applications. Some crimp contacts can have the wire exiting the contact along the same axis as the contact front end.

SUMMARY

In various aspects, a crimp contact is provided where the axes of the contact form a non-linear angle, such as a 90° angle. In various embodiments, the axes of the contact are non-collinear and/or are non-parallel. The crimp contact can be a multi-part contact with a front contact portion that is attached in a removable or fixed manner to the rear crimp contact portion. In some aspects, the front contact portion can be attached to the rear crimp contact portion using a threaded connector to form a threaded attachment.

Aspects of the invention are defined by the claims below, not this summary. A high-level overview of various aspects are provided here to introduce a selection of concepts that are further described in the detailed-description section below. This summary is not intended to identify key features or essential features of the claimed subject matter, nor is this summary intended to be used as an aid in isolation to determine the scope of the claimed subject matter.

BRIEF DESCRIPTION OF THE DRAWINGS

Illustrative embodiments are described in detail below with reference to the attached figures, which are incorporated herein by reference, wherein.

Some embodiments are described below in connection with the aforementioned figures. The figures are drawn to scale, but such scale should not be interpreted to be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated.

DETAILED DESCRIPTION

The subject matter of various aspects described with specificity herein to meet statutory requirements. But the description itself is not intended to necessarily limit the scope of claims. Rather, the claimed subject matter might be embodied in other ways to include different elements or combinations of elements similar to the ones described in this document, in conjunction with other present or future technologies. Various components of the described embodiments can be added, removed, and/or rearranged. The disclosure herein of any particular feature, aspect, method, property, characteristic, quality, attribute, element, or the like in connection with various embodiments can be used in any other embodiments set forth herein.

Figure 1:
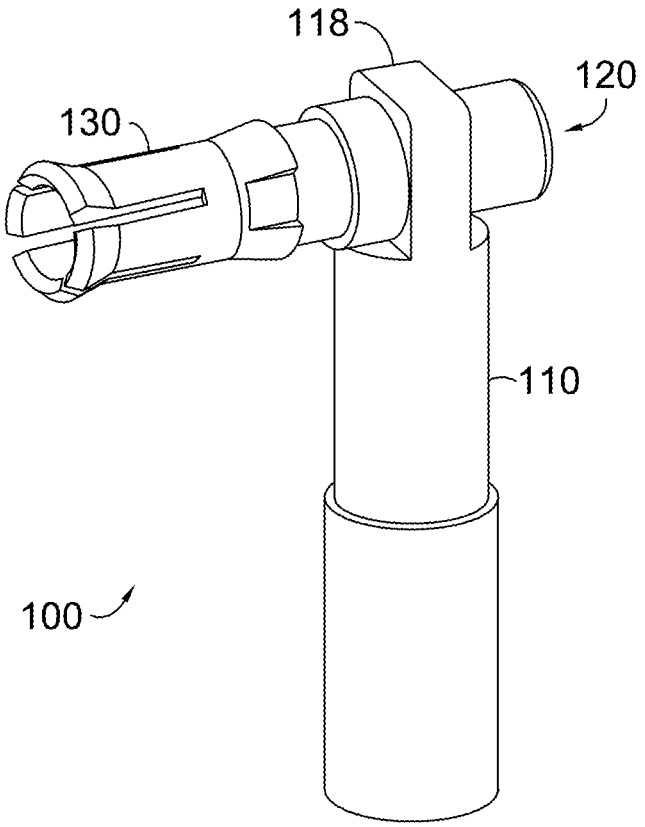
FIG. 1 schematically depicts an example of a multi-part crimp contact.

FIG. 1 shows an example of a crimp contact 100 according to an aspect described herein. In the example shown in FIG. 1, crimp contact 100 can include a front contact portion 130 for receiving a wire or cable, such as a large diameter wire suitable for high power applications. In the description below, the portion of a crimp contact analogous to front contact portion 130 will be referred to as the front contact portion or front contact end of the contact. Crimp contact 100 can further include rear crimp contact portion 110 for receiving a second wire. In the example shown in FIG. 1, the rear crimp contact portion 110 can include a transverse opening in a flattened portion 118 that can receive a rear insert portion of front end 130. The rear insert portion can include a threaded opening to allow a screw, bolt, or other threaded connector 120 to removably attach front contact portion 130 to rear crimp contact portion 110. Alternatively, front contact portion 130 can be attached to rear crimp contact portion 130 in any other convenient manner, such as by welding, soldering, or another form of fixed attachment, or by another form of removable attachment. As another example of removable attachment, front contact portion can include a threaded opening and the rear of rear crimp contact portion can correspond to a threaded (screw) end. In this type of aspect, the threaded opening and threaded screw end can serve to both removably attach the front contact portion and rear crimp contact portion as well as providing electrical contact between the front contact portion and rear crimp contact portion.

Some difficulties in forming contacts for high power applications can be related to the gauge of wire that is typically used in such applications. When a contact is formed in a tight clearance, it may be difficult to bend a larger gauge wire to achieve a right angle bend, or a bend at another type of angle, in order to allow a contact to fit within a desired geometry.

In various aspects, a crimp contact as described herein can provide an option for forming a crimp contact at a non-linear angle, such as a 90° angle, within a constrained geometry. In some embodiments, the axes of the contact are non-collinear and/or are non-parallel. The crimp contact as described herein can additionally or alternately provide various advantages. In some aspects, the two piece design of the contact can allow for mixing and matching of different size front ends and back ends to match sizes for a desired application. In other aspects, the two piece design can facilitate having separate structural and plating material selections for the contact pieces. In still other aspects, a potential benefit can be related to providing a crimp contact where the axis of the front contact portion and rear crimp contact portion of the contact are not co-linear. In yet other aspects, a the two piece design of the contact can provide a reliable method of providing a contact while reducing or minimizing the reliance on external insulation layers to provide support for maintaining the shape of the contact.

In various aspects, a contact can correspond to two portions. A first or front contact portion of the contact can be suitable for receiving an incoming wire or cable. The received cable or wire can be held in place by any convenient method. For example, the front contact portion can include spring arms that can be inserted into an insulating conduit for receiving a wire. The spring arms can contract when inserted into the insulated conduit, and then return to a rest position after the protruding edges at or near the end of the spring arms are past a narrower location within the insulated conduit. The protruding edges of the spring arms can then applying a retaining force against the walls of the conduit. Alternatively, a separate clip located behind the spring arms can provide a retaining force to keep the spring arms seated within the insulated conduit. The spring arms are then in a suitable position for receiving a wire inserted into the insulated conduit, with the spring arms providing the electrical contact with a received wire.

In some aspects, a rear end of the front contact portion can correspond to a pin, post, or other structure that can be inserted through an opening to provide contact with the rear crimp contact portion of the contact. The pin or post of the front contact portion can form a continuous conductor with the interior of the front end where contact is made with a received wire. The pin or post can include a threaded opening at the end of the pin or post.

In such aspects, the pin or post of the front contact portion can be fit within a transverse opening in a flattened (rear) end of the rear crimp contact portion of the contact. From the insertion side, a larger diameter collar can surround the pin or post so that the collar can be seated against the flattened end of the rear crimp contact portion. The front contact portion of the contact can be attached to the rear crimp contact portion of the contact in any convenient manner. One option can be to use a screw to secure the pin or post within the transverse opening. A screw with a head larger than the opening can be used, or the screw can be seated against an intervening conducting washer. Removably attaching the front end portion to the back end portion by use of a screw or another threaded attachment can provide electrical contact without requiring a precise friction fit, as the collar around the pin or post as well as the screw (and optional washer) can provide a large surface area for electrical contact between the front contact portion and the flattened end of the rear crimp contact portion. Other options for securing the front contact portion to the flattened end of the rear crimp contact portion can include fixed methods of attachment, such as welding, riveting, or soldering.

In various aspects, the receiving portion of the front contact portion can have a receiving axis that differs from the receiving axis of the crimp barrel of the rear crimp contact portion. In this description, the receiving axis of a contact portion is defined as an axis parallel to an axis defined by the geometric center of a conductor within the contact, when the conductor is properly seated, crimped, or otherwise secured/attached to either the front contact portion or the rear crimp contact portion. The receiving axis of the front contact portion can be at a 90° angle relative to the receiving axis of the rear crimp contact portion, or at another convenient angle between about 30° and about 150°, such as at least 30°, or at least 45°, or at least 60°, or at least 75°, or at least 90°, and/or 150° or less, or 135° or less, or 120° or less, or 105° or less, or 90° or less. It is noted that each of the above minimum angles is explicitly contemplated in conjunction with each of the above maximum angles.

In other aspects, the rear end of the front contact portion can instead have a threaded opening, where the screw axis of the threaded opening is preferably not aligned with the receiving axis of the receiving portion of the front contact portion. The screw axis can be at a 90° angle relative to the axis of the receiving portion, or at another convenient angle between about 30° and about 150°, such as at least 30°, or at least 45°, or at least 60°, or at least 75°, or at least 90°, and/or 150° or less, or 135° or less, or 120° or less, or 105° or less, or 90° or less. It is noted that each of the above minimum angles is explicitly contemplated in conjunction with each of the above maximum angles. In such aspects, contact between the front contact portion of the contact and the rear crimp contact portion of the contact can be made based on a rear end of the rear crimp contact portion corresponding to a threaded screw.

In some aspects, the angle between the receiving axis of the front contact portion and the receiving axis of the rear crimp contact portion (and/or the axis of the threaded opening) can be substantially 90°. In such aspects, substantially 90° is defined as an angle that is within 3° of 90°, such as within 1° of 90°, or within 0.5° within 90°.

In various aspects, the rear crimp portion of the contact can be selected to have a crimp barrel of any convenient size. For high power applications, the crimp barrel size (inner diameter) can be suitable for receiving and crimping a wire having a diameter of at least about: 2 mm (about 12 AWG or larger), 3 mm (about 8 AWG or larger), 4 mm (about 4 AWG or larger), 5 mm (about 2 AWG or larger), 12 mm, or more. The crimp barrel size can be similar to the size of the wire received by the front contact portion, or the crimp barrel size can be larger than the wire received by the front contact portion, or the crimp barrel size can be smaller than the wire received by the front contact portion.

Figure 2:
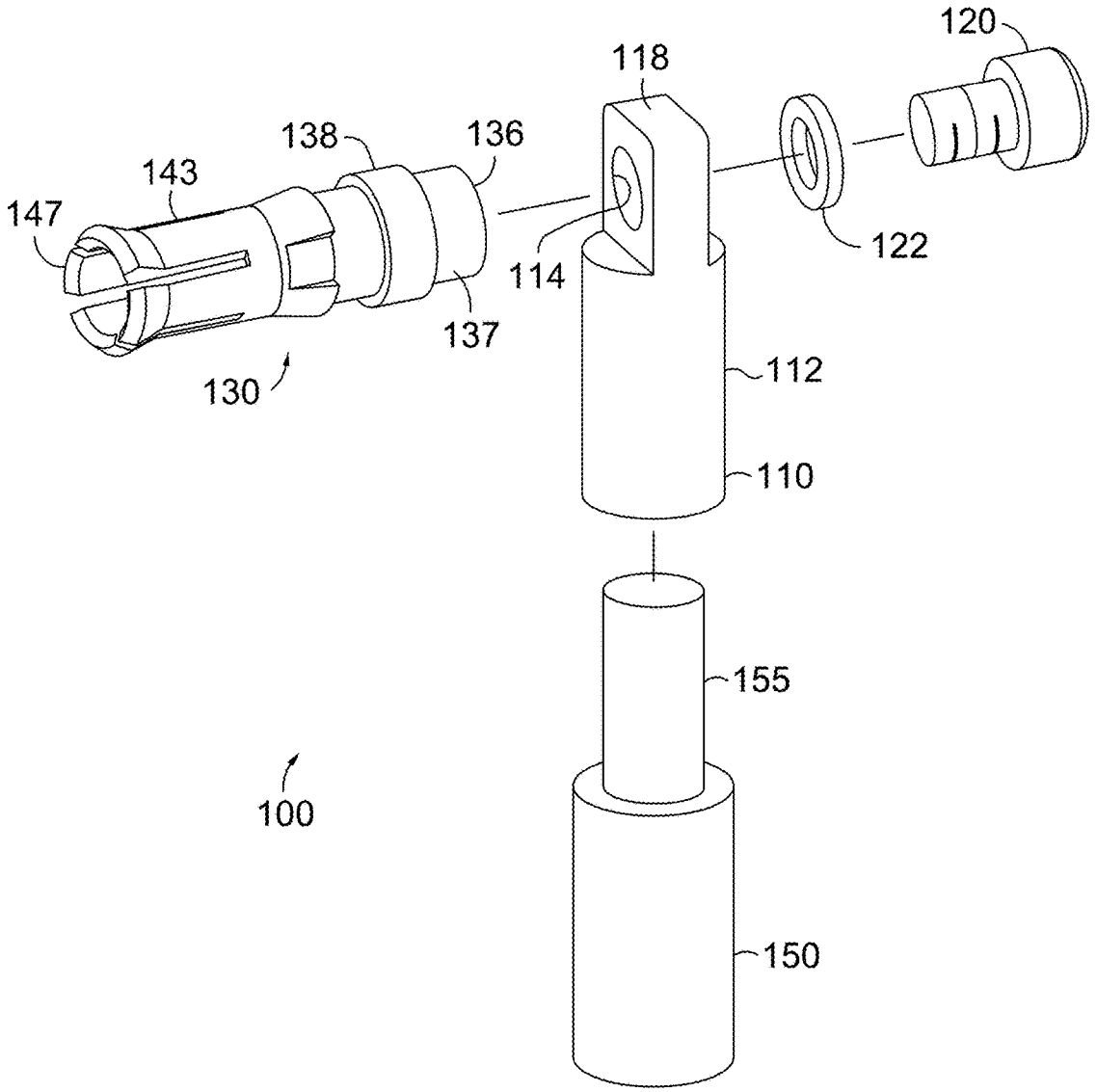
FIG. 2 schematically shows an exploded view of the multi-part crimp contact from FIG. 1.

To further illustrate aspects described herein, FIG. 2 schematically shows an exploded view of the contact 100 depicted in FIG. 1. In the aspect shown in FIG. 2, front contact portion 130 includes receiving spring arms 143 with end tabs or flanges 147, an optional retaining clip, a collar 138, and a pin or post 137 for insertion into a transverse opening 114 of rear crimp portion 110. The collar 138 can seat substantially flush against flattened end 118 of rear crimp portion 110 to provide at least a portion of a suitable contact area for electric conductivity. In the aspect shown in FIG. 2, the front end 130 can be removably attached to rear crimp portion 110 by inserting a threaded connector 120 into a threaded opening 136 in the face of pin or post 137. A washer 122 can be included between the head of threaded connector 120 and the surface of flattened end 118. In the aspect shown in FIG. 2, rear crimp portion 110 can include a crimp barrel 112 to provide an electrical connection with conductor 155 of wire 150.

In a multi-part contact such as the example shown in FIG. 2, forming the contact from multiple parts can allow for selection of different materials for the various pieces. For example, crimp barrel or lug 112 can correspond to a copper alloy substrate that is plated with a gold-nickel alloy. This can be the same or different from the materials used for shoulder 138 and pin or post 137 of front portion 110. Threaded connector 120 can correspond to a stainless steel substrate with a zinc coating, while optional washer 122 can be composed of a copper alloy. The different material selections for substrate and/or plating or coating described above are exemplary. More generally, the separate nature of the multiple parts of connectors described herein can allow for separate selection of substrates or plating materials based on any convenient criteria.

Figure 3:
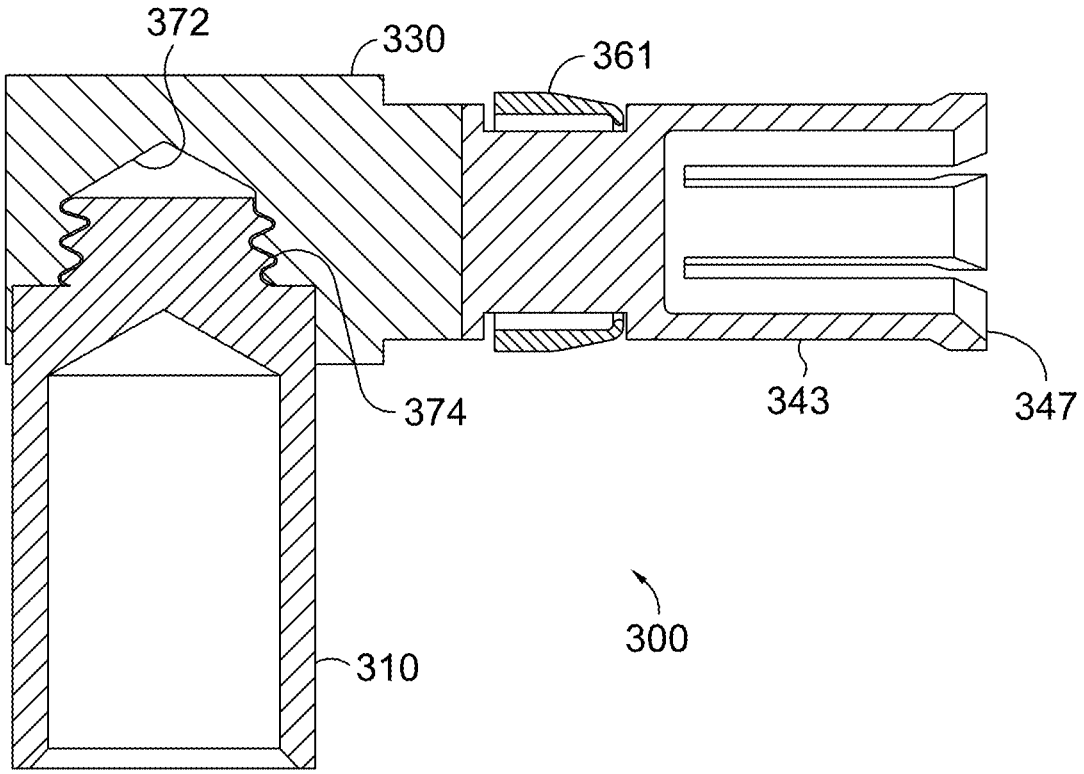
FIG. 3 schematically shows an alternative aspect of a multi-part crimp contact.

FIG. 3 shows another example of a method for removably attaching a front contact portion and a rear crimp contact portion of a two-part contact (or multi-part contact) as described herein. In the exemplary contact 300 shown in FIG. 3, front contact portion 330 includes receiving spring arms 343 with associated end tabs 347. Front contact portion 330 also shows an optional retaining clip 361 that can be suitable for securing or retaining the contact 300 within an insulated housing. In the aspect shown in FIG. 3, instead of a collar and a pin or post, front contact portion 330 can include a threaded opening 372. Rear crimp contact portion 310 can then include a similar threaded end 374 so that rear crimp contact portion 310 can be removably attached to front contact portion 330 via threaded opening 372.

CERTAIN ADDITIONAL EMBODIMENTS

Embodiment 1

A multi-part crimp contact, comprising: a front contact portion adapted to receive a conductor at a front end of the front contact portion; and a rear crimp contact portion comprising a crimp barrel adapted to receive a conductor at a front end of the rear crimp contact portion, a rear end of the rear crimp contact portion being removably attached to a rear end of the front contact portion, an electrical contact between the front contact portion and the rear crimp contact being provided at least in part by removably attached portions of the front contact portion and the rear crimp contact portion, wherein a receiving axis of the front end of the front contact portion and a receiving axis of the front end of the rear crimp contact portion form an angle of about 30° to about 150°.

Embodiment 2

The multi-part contact of Embodiment 1, wherein the front contact portion and the rear crimp contact portion being removably attached comprises the front contact portion and the rear crimp contact portion being attached using a threaded connector.

Embodiment 3

The multi-part contact of any of the above embodiments, wherein the front contact portion comprises a rear end having a post, the post having a threaded opening, the front contact portion being removably attached to the rear crimp contact portion using a threaded connector.

Embodiment 4

The multi-part contact of any of the above embodiments, wherein the rear crimp contact portion comprises a flattened end with a transverse opening, the front contact portion being secured to the rear crimp contact portion based on insertion of a post of the front contact portion into the transverse opening and attachment of the post to the flattened end.

Embodiment 5

The multi-part contact of Embodiments 1 or 2, wherein a rear end of the front contact portion comprises a threaded opening, a rear end of the rear crimp contact portion comprises a threaded connector, and the front contact portion is removably attached to the rear crimp contact portion by threaded attachment of the threaded connector and the threaded opening.

Embodiment 6

A multi-part electrical crimp contact, comprising: a front contact portion adapted to receive a conductor at a front end of the front contact portion, a rear end of the front contact portion comprising a post; and a rear crimp contact portion comprising a crimp barrel adapted to receive a conductor at a front end of the rear crimp contact portion, a rear end of the rear crimp contact portion comprising a flattened end with a transverse opening, the front contact portion being secured to the rear crimp contact portion based on insertion of the post into the transverse opening and attachment of the post to the flattened end, an electrical conductivity between the front contact portion and the rear crimp contact being provided at least in part by attachment of the post to the flattened end, wherein a receiving axis of the front end of the front contact portion and a receiving axis of the front end of the rear crimp contact portion form an angle of about 30° to about 150°.

Embodiment 7

The multi-part contact of Embodiment 6, wherein the front contact portion is attached in a fixed manner to the rear crimp contact portion.

Embodiment 8

The multi-part contact of Embodiment 7, wherein the front contact portion is attached in a fixed manner to the rear crimp contact portion by welding, soldering, riveting, or a combination thereof.

Embodiment 9

A multi-part electrical crimp contact, comprising: a front contact portion adapted to receive a conductor at a front end of the front contact portion, a rear end of the front contact portion comprising a threaded opening; and a rear crimp contact portion comprising a crimp barrel adapted to receive a conductor at a front end of the rear crimp contact portion, a rear end of the rear crimp contact portion comprising a threaded portion, the front contact portion being secured to the rear crimp contact portion based threaded attachment of the threaded portion of the rear crimp contact portion with the threaded opening of the front contact portion, an electrical conductivity between the front contact portion and the rear crimp contact being provided at least in part by the threaded attachment, wherein a receiving axis of the front end of the front contact portion and a receiving axis of the threaded opening of the rear end of the front contact portion form an angle of about 30° to about 150°.

Embodiment 10

The multi-part contact of any of the above embodiments, wherein the receiving axis of the front end of the front contact portion and the receiving axis of the front end of the rear crimp contact portion (and/or the receiving axis of the threaded opening) form an angle of about 75° to about 105°, or form an angle of substantially 90°.

Embodiment 11

The multi-part contact of any of Embodiments 1 to 10, wherein the receiving axis of the front end of the front contact portion and the receiving axis of the front end of the rear crimp contact portion (and/or the receiving axis of the threaded opening) form an angle of at least about 45°, or at least about 60°, or at least about 75°, or at least about 90°, and/or about 135° or less, or about 120° or less, or about 105° or less, or about 90° or less.

Embodiment 12

The multi-part contact of any of the above embodiments, wherein an inner diameter of the crimp barrel is at least about 3 mm, or at least about 4 mm, or at least about 5 mm, and/or about 10 mm or less.

Embodiment 13

The multi-part contact of any of the above embodiments, wherein a plating material for the rear end of the rear crimp contact portion is different from a plating material for the rear end of the front contact portion.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

Certain Terminology

Terms of orientation used herein, such as "top," "bottom," "horizontal," "vertical," "longitudinal," "lateral," and "end" are used in the context of the illustrated embodiments. However, the present disclosure should not be limited to the illustrated orientations. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 20 degrees, and the term "generally perpendicular" can refer to something that departs from exactly perpendicular by less than or equal to 20 degrees.

In addition, language of degree used herein, such as the terms "about" and "substantially," represent a value, amount, or characteristic close to the stated value, amount, or characteristic that still performs a desired function or achieves a desired result. The language of degree can thus be used in referring to a relationship between two objects that reflects both an exact relationship and also variances in that relationship due to various factors, such as effects of environmental conditions, common error tolerances, or the like. It should further be understood that although some values or other relationships may be expressed herein without a modifier, these values or other relationships may be exact or may include a degree of variation due to various factors, such as the effects of environmental conditions, common error tolerances, or the like.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Conclusion

Various embodiments and examples of crimp contacts have been disclosed. Although the crimp contacts have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Thus, the scope of this disclosure should not be limited by the particular disclosed embodiments described above, but should be determined only by a fair reading of the claims that follow.

What is claimed is:

1. A multi-part crimp contact, comprising:

a front contact portion adapted to receive a conductor at a front end of the front contact portion, a rear end of the front contact portion comprising a post, the post comprising a threaded opening configured to receive a threaded connector; and a rear crimp contact portion comprising:

a crimp barrel adapted to receive a conductor at a front end of the rear crimp contact portion, a rear end that is removably attached to the rear end of the front contact portion, wherein the rear end of the rear crimp contact portion comprises a transverse opening configured to receive the post, and an electrical contact between the front contact portion and the rear crimp contact portion being provided at least in part by removably attached portions of the front contact portion and the rear crimp contact portion, wherein a receiving axis of the front end of the front contact portion and a receiving axis of the front end of the rear crimp contact portion form an angle of about 30° to about 150°.

2. The multi-part contact of claim 1, wherein the front contact portion and the rear crimp contact portion being removably attached comprises the front contact portion and the rear crimp contact portion being attached using the threaded connector.

3. The multi-part contact of claim 1, wherein the rear crimp contact portion comprises a flattened end with the transverse opening, the front contact portion being secured to the rear crimp contact portion based on insertion of the post of the front contact portion into the transverse opening and attachment of the post to the flattened end.

4. The multi-part contact of claim 1, wherein the rear end of the front contact portion comprises the threaded opening, the rear end of the rear crimp contact portion comprises the threaded connector, and the front contact portion is removably attached to the rear crimp contact portion by threaded attachment of the threaded connector and the threaded opening.

5. The multi-part contact of claim 1, wherein the receiving axis of the front end of the front contact portion and the receiving axis of the front end of the rear crimp contact portion form an angle of about 75° to about 105°.

6. The multi-part contact of claim 1, wherein the receiving axis of the front end of the front contact portion and the receiving axis of the front end of the rear crimp contact portion form an angle of substantially 90°.

7. The multi-part contact of claim 1, wherein an inner diameter of the crimp barrel is at least about 2 mm.

8. The multi-part contact of claim 1, wherein a plating material for the rear end of the rear crimp contact portion is different from a plating material for the rear end of the front contact portion.

9. A multi-part electrical crimp contact, comprising:

a front contact portion adapted to receive a conductor at a front end of the front contact portion, a rear end of the front contact portion comprising a post forming an opening configured to receive a connector; and a rear crimp contact portion comprising:

a crimp barrel adapted to receive a conductor at a front end of the rear crimp contact portion, a rear end of the rear crimp contact portion comprising a flattened end with a transverse opening, the front contact portion being secured to the rear crimp contact portion based on insertion of the post into the transverse opening and attachment of the post to the flattened end, an electrical conductivity between the front contact portion and the rear crimp contact being provided at least in part by attachment of the post to the flattened end, wherein a receiving axis of the front end of the front contact portion and a receiving axis of the front end of the rear crimp contact portion form an angle of about 30° to about 150°.

10. The multi-part contact of claim 9, wherein the front contact portion is attached in a fixed manner to the rear crimp contact portion.

11. The multi-part contact of claim 10, wherein the front contact portion is attached in a fixed manner to the rear crimp contact portion by welding, soldering, riveting, or a combination thereof.

12. The multi-part contact of claim 9, wherein the receiving axis of the front end of the front contact portion and the receiving axis of the front end of the rear crimp contact portion form an angle of about 75° to about 105°.

13. The multi-part contact of claim 9, wherein the receiving axis of the front end of the front contact portion and the receiving axis of the front end of the rear crimp contact portion form an angle of substantially 90°.

14. The multi-part contact of claim 9, wherein an inner diameter of the crimp barrel is at least about 2 mm.

15. A multi-part electrical crimp contact, comprising:

a front contact portion adapted to receive a conductor at a front end of the front contact portion, a rear end of the front contact portion comprising a threaded opening; and a rear crimp contact portion comprising:

a crimp barrel adapted to receive a conductor at a front end of the rear crimp contact portion, and a rear end of the rear crimp contact portion comprising a threaded portion, wherein the front contact portion is secured to the rear crimp contact portion by threaded attachment of the threaded portion of the rear crimp contact portion with the threaded opening of the front contact portion, wherein electrical conductivity between the front contact portion and the rear crimp contact being is provided at least in part by the threaded attachment, wherein a receiving axis of the front end of the front contact portion and a receiving axis of the threaded opening of the rear end of the front contact portion form an angle of about 30° to about 150°.

16. The multi-part contact of claim 15, wherein the receiving axis of the front end of the front contact portion and the receiving axis of the threaded opening form an angle of about 75° to about 105°.

17. The multi-part contact of claim 15, wherein the receiving axis of the front end of the front contact portion and the receiving axis of the threaded opening form an angle of substantially 90°.

18. The multi-part contact of claim 15, wherein an inner diameter of the crimp barrel is at least about 2 mm.

19. The multi-part contact of claim 15, wherein a plating material for the threaded connector of the rear crimp contact portion is different from a plating material for the threaded opening of the front contact portion.

* * * * *